US006951671B2

(12) United States Patent
Mukherjee et al.

(10) Patent No.: US 6,951,671 B2
(45) Date of Patent: Oct. 4, 2005

(54) INK JET PRINTABLE HEAT TRANSFER PAPER

(75) Inventors: Debabrata Mukherjee, Spring Grove, PA (US); Jeffrey E. Gleim, Spring Grove, PA (US); Daniel L. Krueger, York, PA (US); Donald E. Golden, Spring Grove, PA (US); Timothy R. Hess, Dallastown, PA (US)

(73) Assignee: P. H. Glatfelter Company, York, PA (US)

( * ) Notice: Subject to any disclaimer, the term of this patent is extended or adjusted under 35 U.S.C. 154(b) by 292 days.

(21) Appl. No.: 09/839,793

(22) Filed: Apr. 20, 2001

(65) Prior Publication Data

US 2003/0021962 A1 Jan. 30, 2003

(51) Int. Cl.[7] ..... B41M 5/40
(52) U.S. Cl. ..... 428/32.12
(58) Field of Search ..... 428/32.12

(56) References Cited

U.S. PATENT DOCUMENTS 4,235,657 A 11/1980 Greenman et al.
4,284,456 A 8/1981 Hare
4,294,641 A 10/1981 Reed et al.
4,664,670 A 5/1987 Mehl et al.
4,664,952 A 5/1987 Arai (Continued)

*Primary Examiner*—B. Shewareged
(74) *Attorney, Agent, or Firm*—Marc J. Farrell; Buchanan Ingersoll PC

(57) ABSTRACT

This patent describes an ink jet printable heat transfer material with cold release properties. The invention consists of multiple layers of coatings applied to a suitable substrate, typically paper. The first optional layer coating consists typically of a pigmented coating bound together with a synthetic or natural binder and is applied in sufficient quantity to level and densify the surface of a given substrate. The second coating is applied over the first and consists of a silicone coating with a controlled surface energy. The surface energy must be such that the subsequent aqueous coatings can be applied over top with good wetting and adhesion, but low enough for an easy removal from the heat transfer after cooling. A third or wash layer is applied over the silicone release layer. This layer must easily wet and adhere to the silicone release layer so the coating does not come off during subsequent coating passes and during handling by the user. The wash layer consists of one or more thermoplastic polymers including ethylene acrylic acid, waxes, and other polymers along with dispersions of non-water soluble plasticizers and antioxidants. An ink receptive layer consists of a low binder thermoplastic organic pigmented coating containing non-water soluble plasticizers and antioxidants along with water soluble and insoluble cationic polymers and/or cationic inorganic pigments. The non-water soluble cationic materials, either organic or inorganic, aid in the retention of the dyes and reduce the wet bleed and wash out of the dyes when the transfers get wet.

43 Claims, 3 Drawing Sheets

U.S. PATENT DOCUMENTS 4,758,952 A 7/1988 Harris, Jr. et al.
4,767,420 A 8/1988 Mehl et al.
4,773,953 A 9/1988 Hare
4,844,770 A 7/1989 Shiraishi et al.
4,956,223 A 9/1990 Arai
4,966,815 A 10/1990 Hare
4,980,224 A 12/1990 Hare
5,055,444 A 10/1991 Kaszczuk
5,139,917 A 8/1992 Hare
5,236,801 A 8/1993 Hare
5,242,739 A * 9/1993 Kronzer et al. ..... 428/200
5,487,614 A 1/1996 Hale
5,501,902 A 3/1996 Kronzer
5,612,281 A 3/1997 Kobayashi et al.
5,672,413 A * 9/1997 Taylor et al. ..... 428/195
5,756,212 A 5/1998 Liebler et al.
5,985,453 A 11/1999 Moriya et al.
6,036,808 A 3/2000 Shaw-Klein et al.
6,071,368 A 6/2000 Boyd et al.
6,080,261 A * 6/2000 Popat et al. ..... 156/240
6,200,668 B1 * 3/2001 Kronzer ..... 428/195
6,210,808 B1 4/2001 Naisby
6,296,901 B1 10/2001 Boyd et al.
6,319,591 B1 11/2001 Malhotra
6,361,853 B1 3/2002 Shaw-Klein et al.
6,372,329 B1 4/2002 Graczyk et al.
6,380,280 B1 4/2002 Kapusniak et al.
6,387,473 B1 5/2002 Sismondi et al.
6,403,198 B1 6/2002 Urasaki
6,406,138 B1 6/2002 Gore
6,534,123 B1 * 3/2003 Mukherjee et al. ..... 427/245
2002/0192434 A1 * 12/2002 Yuan et al. ..... 428/195

* cited by examiner

INK JET PRINTABLE HEAT TRANSFER PAPER

BACKGROUND OF THE INVENTION

The present invention relates to a heat transfer media suitable for transferring images printed using any ink jet printer to a wide range of materials, including but not limited to pliable materials including cloth and fabric, and rigid materials including ceramic, wood, and heat resistant plastic among many other options.

Much effort has been put forth to allow home users to produce for example, but not limited to custom t-shirts, mouse pads, craft items, and flags. Though the original heat transfer concept using screen printed images has existed for over 30 years, only recently has the proliferation of home computers along with readily available and affordable color ink jet printers allowed home users to make image transfers at home.

The use of heat transfer materials is not restricted to home users. Many small commercial shops can use such materials to generate custom printed shirts, mouse pads, hats, and mugs among many other options. Currently available products lack good ink jet print quality because the image either takes a long time to dry which makes the image susceptible to smearing, or has poorly defined clarity and resolution due to ink wicking and bleeding; do not have good washability because the image fades or cracks after just a few washing and drying cycles in residential washing equipment; tends to yellow either when the image is transferred or over time, which reduces the aesthetic desirability, or does not offer sufficient abrasion resistance when the image is transferred to rigid materials including ceramic mugs. Additionally, the separation of the substrate layer from the transferred object for many products must be done while the image is still hot. This can be difficult for home users to do consistently without either burning their fingers or damaging the transferred image.

SUMMARY OF THE INVENTION

The present invention addresses the shortcomings of commercially available ink jet printable heat transfer materials. The described media offers cold release properties, whereby the transferred image is separated from the cold release layer after the transfer is made by heat and the material has cooled to room temperature. This allows for much higher quality and more consistent transfers. Additionally, through the use of unique chemistry described below, the ink jet print quality, washability, yellowing resistance, and resistance to abrasion are excellent.

This transfer media comprises a paper substrate sheet of any caliper; a cold release layer on the substrate or an optional precoat, which cold release layer is comprised of silicone and a matting agent; a wash layer, preferably over the cold release layer, comprised primarily of ethylene acrylic acid (EAA) and surface feel modifiers (also called "hand modifiers"); and an ink receptive layer, preferably over the wash layer, which ink receptive layer comprises primarily cationic polymers, hand modifiers, antioxidants, and high porosity inorganic and synthetic organic pigments, including but not limited to polyamides, titanium, calcium carbonate, silicas, and aluminas.

Another embodiment of the invention comprises a cold release layer, a wash layer and an ink receptive layer with an optional precoat layer, all on a substrate.

Another embodiment comprises a cold release layer material having one or more silicones, one or more crosslinkers, one or more matting agents and one or more controlled release additives for silicone chemistries.

In another embodiment, a wash layer material comprises one or more ethylene acrylic acids, one or more non-water soluble plasticizers, one or more urethane adhesion promoters, one or more fluorosurfactant wetting and flow agents, one or more hard waxes, a mixture of water-soluble and non-water soluble cationic polymers and one or more non-water soluble antioxidants.

Yet another embodiment comprises an ink receptive layer material comprising one or more polyethylene waxes; one or more high porosity polyamide powders, one or more ethylene-vinyl chloride emulsions, one or more non-water soluble cationic polymers, one or more non-water soluble cationic polymers, one or more non-water soluble plasticizers, one or more non-water soluble antioxidants, a mixture of flow and wetting agents and one or more high porosity silicas.

BRIEF DESCRIPTION OF DRAWINGS

The invention will become more readily apparent from the following description of preferred embodiments thereof shown, by way of example only, in the accompanying drawings wherein.

DETAILED DESCRIPTION

Figure 1:
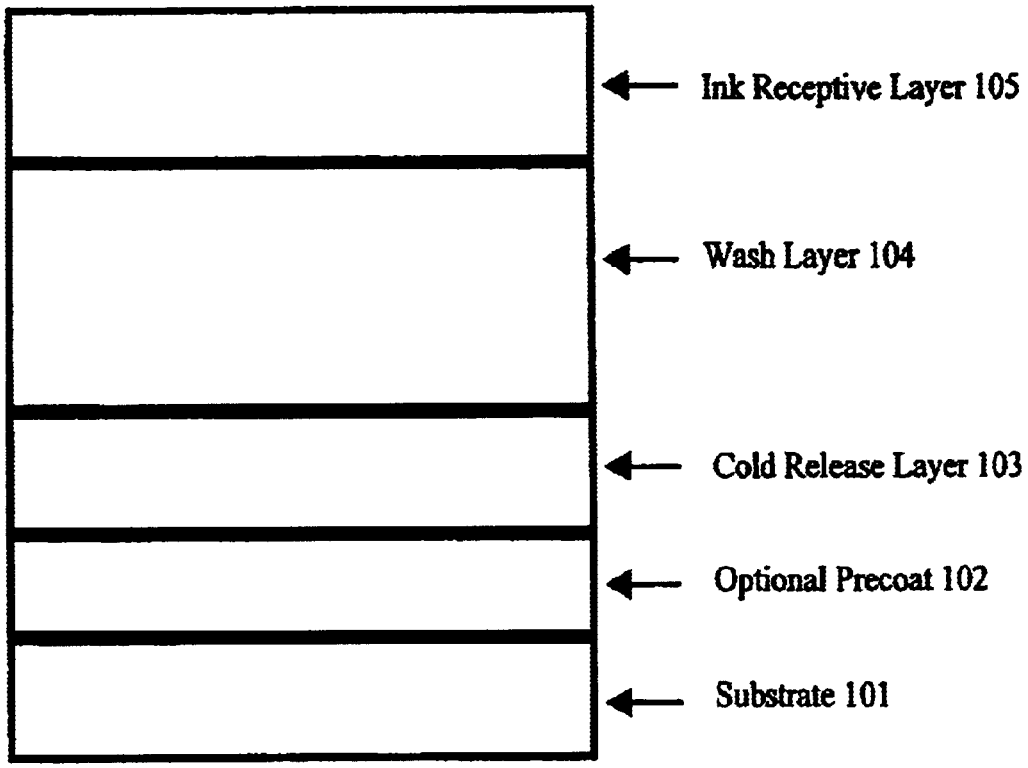
FIG. 1 is a cross-sectional view of the invention depicting the various layers of paper base and coatings of the invention.

In the heat transfer media of the present invention depicted in FIG. 1, the substrate (or "paper base") 101 comprises a paper base comprising of any blend of hardwood and softwood fibers; starches including but not limited to oxidized, corn, potato, and cationic; high levels (preferably about 10 to about 40%) of inorganic fillers including but not limited to clay, calcium carbonate, and aluminas; retention aids and formation aids of any nature; slip agents including but not limited to stearates; optical brighteners and dyes known to one skilled in the art; hydrophobic additives including, but not limited to alkenyl succinic anhyride ("ASA") and alkyl ketene dimer ("AKD"); and other paper making additives known to those skilled in the art.

The pre-coat layer (or "optional precoat" or "optional precoat layer") 102 is not needed if the substrate 101 is either a super calandered kraft sheet (SCK), film, or a polyextruded sheet. These sheets are well know to those skilled in the art. This optional precoat 102 gives a smooth surface with excellent "holdout", or lack or absorbency, to allow for low coat weights of the cold release layer 103 while maintaining the desired release properties. An absorbent substrate 101 requires the use of uneconomical amounts of cold release layer coating 103 to give the desired release properties, thus a substrate 101 with low absorbency is desirable.

The optional precoat layer 102 comprises about 5 to about 90 dry percent of natural and synthesized inorganic pigments including, but not limited to, clay, calcium carbonate, titanium dioxide, and aluminas; about 1 to about 50 dry percent of latex binders, including but not limited to styrene-butadiene, poly-vinyl acetate, acrylics, vinyl-acetate, ethylene-vinyl chloride, and urethanes; about 0 to about 50 dry percent binders including but not limited to starch, protein, polyvinyl alcohol, and gelatin; flow and slip agents known to one skilled in the art; optical brighteners and dyes known to one skilled in the art; and other optional common coating additives known to those skilled in the art. The precoat layer 102 can be coated at a coat weight of about 1 to about 50 dry gsm, preferably about 11 to about 23 dry gsm, on any coater including but not limited to blade, rod, gate-roll, slot die, cascade, and gravure.

The cold release layer (or "silicone layer") 103 in this invention is unique in that it is based upon silicone chemistry. The silicone surface energy is such that a properly formulated wash layer 104 can be coated upon it. However, after transferring the image using heat and cooling, the silicone layer 103 will cleanly release from the wash layer 104. This cold release layer 103 contains from about 1 to about 99 dry percent silicone, including but not limited to thermally curable solvent based silicone, thermally curable solventless silicone, thermally curable emulsion silicone, ultra-violet curable acrylate-silicone, and ultra-violet curable epoxy-silicone chemistries; about 1 to about 20 dry percent crosslinker, including but not limited to tin catalyzed, platinum catalyzed, ultra-violet free radical catalyzed, and ultra-violet cationic catalyzed; about 0 to about 50 dry percent matting agent, including but not limited to silicas (gel, fumed, precipitated, and solgel), silicates, nylon copolymers, calcium carbonate (ground and precipitated), aluminas, and clays; about 0 to about 25 dry percent controlled release additives (CRA) for silicone chemistry known to one skilled in the art; and optionally defoamers, dyes, and optical brighteners known to one skilled in the art. The ultra-violet curable acrylate-silicone and ultra-violet curable epoxy-silicone chemistries may also be cured via electron-beam (EB) energies. The cold release layer 103 can be coated at a coat weight of about 0.5 to about 7 dry gsm, preferably about 1 to about 5 dry gsm on any coater, including but not limited to blade, rod, gate-roll, slot die, cascade, and gravure.

The wash layer 104 in this invention is unique in that it contains a non-water soluble plasticizer. These dispersants keep the transfer soft and pliable, giving the desirable feel or "hand" to the transfer, especially onto cloth. Though water soluble dispersants, including polyethylene glycol, will give a good hand immediately after transfer, they wash out in one or more wash cycles, leaving a transfer that is rougher, more rigid, and likely to crack over time. In this invention, the transfer will remain soft and pliable over time and not crack, even after many wash cycles. These non-water soluble plasticizers in the wash layer 104 make a coating that is less water sensitive than those containing water soluble materials, thus improving washability over time. Poor washability is defined as cracking, peeling, and/or loss of image brilliance.

Also unique in this invention is that the wash layer 104 contains fluorosurfactant wetting agents. There are many surfactant chemistries available, however, fluorosurfactants are the best at wetting out silicone bases. It can be difficult or impossible to get good adhesion of the wash layer 104 to the cold release layer 103 without fluorosurfactants. Fluorosurfactants have the added characteristic that they do not give permanent adhesion so that the cold release layer 103 can be peeled off after the transfer is made.

Also unique in this invention is a modification of the wash layer 104 that contains the addition of a hard polyethylene and/or polypropylene wax. The wax produces a coating which is more abrasion resistant due to its hardness & higher softening point than common heat transfer materials. This yields a transfer material which is well suited for transfer onto rigid materials, including ceramic mugs, where abrasion resistance is more important than flexibility. Additionally, the plasticizers, used in most of the other coatings described herein, may also be left out of the formulation of wash layer 104 to further harden the coating.

Also unique in this invention is that the wash layer 104 additionally contains a non-water soluble antioxidant. The antioxidant prevents yellowing either with the application of excessive heat or over time (which are the shortcomings of most commercially available transfer sheets). Most heat transfer components, including wax, EAA, and copolyamide will yellow when subjected to excessive high temperature. It is important that the antioxidant not be water soluble so that it is not washed out by the end user. Antioxidants that are water soluble may help prevent yellowing during the transfer, but are removed during subsequent wash cycles, allowing for yellowing over time.

Another key component of this invention in the wash layer 104 is the addition of cationic polymers, both water soluble and non-water soluble. The cationic polymers chemically interact with the ink jet inks by forming salt precipitates of the dyes. These precipitates retain the original color of the dye, but prevent the dye from being water soluble (which is its natural state). Consequently, the dyes are locked into the structure and do not wash out of the transfer. This prevents the image from fading over time even after multiple wash cycles.

The wash layer 104 in this invention comprises about 10 to about 100 dry percent EAA, about 0 to about 30 dry percent non-water soluble plasticizer, about 0 to about 50 dry percent ethylene-vinyl chloride, about 0 to about 50 dry percent urethane adhesion promoter, about 0 to about 5 dry percent fluorosurfactant wetting and flow agent, about 0 to about 100 dry percent copolyamine resin, about 0 to about 100 dry percent polyethylene wax, about 0 to about 10 dry percent non-water soluble antioxidant, and about 0 to about 20 dry percent both water soluble and non-water soluble cationic polymer. Antifoaming agents may be optionally incorporated. The wash layer 104 can be coated at a coat weight of 1–100 dry gsm, preferably 30–40 dry gsm, on any coater including but not limited to blade, rod, gate-roll, slot die, extrusion, cascade, and gravure.

The ink receptive layer 105 in this invention contains a structure primarily made up of non-water soluble, yet ink receptive, materials. Before transferring with heat, this ink receptive layer 105 remains quite porous absorbing the inks. After transfer, however, the ink receptive layer 105 melts and coalesces, trapping the inks within itself, forming a layer that is water resistant.

The ink receptive layer 105, in this invention, is unique in that it contains water soluble and non-water soluble cationic polymers. The cationic polymers chemically interact with the ink jet inks by forming salt precipitates of the dyes. These precipitates retain the original color of the dye, but prevent the dye from being water soluble (which is its natural state). Consequently, the dyes are locked into the structure and do not wash out of the transfer. Non-water soluble materials are critical so that they, along with any dye precipitated on their cationic surface, cannot wash out of the structure over time. This prevents the image from fading as a result of multiple wash cycles. Ideally, though not required, these non-soluble cationic materials will melt and coalesce with the rest of the ink receptive layer 105 components during transfer. The $T_g$ of the water-insoluble cationic polymers should be high enough to be non-film formers at the temperatures used to dry the coating. This allows the addition of substantial quantities of the polymers while maintaining an open porous coating with good ink receptivity. A water soluble cationic polymer, which improves the crispness and sharpness of the printed image compared to many commercially available sheets, is also incorporated into the coating. Without this polymer, the ink will "wick", or form rough edges due to capillary action transporting the ink laterally across the printed surface. The cationic polymer chemically traps the dyes so that they cannot move through the sheet. Though this polymer can wash out, the dyes are retained during washing by the non-water soluble cationic polymer and by encapsulation in the polymer matrix.

The ink receptive layer 105 in this invention also contains polyethylene wax which makes this structure more easily fused so the dyes are better encapsulated in the polymer matrix and less likely to wash out.

Also unique in the ink receptive layer 105 in this invention is the addition of a non-ionically dispersed ethylene-vinyl chloride emulsion, incorporated as a binder to hold the porous structure together before transfer of the image. The ethylene-vinyl chloride emulsion is a good binder giving the surface strength at low addition levels, is non-ionically dispersed for compatibility with cationic materials in the coating, is a soft polymer and thus contributes to the soft hand when transferred to fabrics like T-shirts, and due to the low levels needed does not reduce the coating porosity, making it ideal for this application. A coating without this binder will be too fragile to feed through an ink jet printer without dusting, flaking, and scratching. Dust from the sheet will eventually jam the printer feed mechanism. Flaking and scratching will cause defects in the image.

Also unique in the ink receptive layer 105 in this invention is the addition of non-water soluble antioxidants to prevent yellowing as discussed previously.

Another unique component to the ink receptive layer 105 is the incorporation of one or more non-water soluble plasticizer. Most aqueous coatings utilize a water soluble plasticizers including polyethylene glycols. These can wash out over time and result in the embrittling and cracking of the transferred image. A non-water soluble plasticizer will not wash out easily thus maintaining the flexibility of the transfer for a much longer time. Plasticizers also improve the melt flow characteristics of the polymers during heat transfer. A lower melt viscosity during transfer helps the image penetrate into the fabric, improving adhesion and lessening the likelihood of the coating flaking off.

Additionally unique, in the ink receptive layer 105 in this invention, is the addition of an inorganic high porosity silica or alumina pigment to help absorb ink to produce a sharper image. Silica and alumina are non-water soluble, yet absorb ink jet ink, giving a porous structure before transfer. After the transfer, the silica or alumina is trapped within the coalesced structure. The silica and aluminas can be cationic or have a cationic surface treatment to help retain the dyes in an insoluble state during washing. This is particularly important the first time the transfer gets wet. Transfers in the prior art lose a small amount of dyes the first time they are washed. If they are allowed to air dry from a wet state before the first washing they will all show color bleed due to this small amount of dye migrating with the water from point to point as the water evaporates unequally from the surface of the fabric. The addition of a cationic alumina, including a psuedobohemite, has been shown by the inventors to reduce this wet bleed.

The ink receptive layer 105 comprises from about 0 to about 50 dry percent polyethylene wax, about 50 to about 95 dry percent high porosity polyamide powder, about 0 to about 20 dry percent ethylene-vinyl chloride, about 1 to about 15 dry percent water soluble cationic polymer, about 1 to about 20 dry percent non-water soluble cationic polymer, about 1 to about 40 dry percent non-water soluble plasticizer, about 0 to about 10 dry percent non-water soluble antioxidant, about 0 to about 5 dry percent flow and wetting agents, and about 0 to about 80 dry percent high porosity material which may be gel silica, precipitated silica, fumed silica, solgel silica, alumina or a combination thereof. Antifoaming agents may be optionally incorporated. The ink receptive layer 105 can be coated at a coat weight of about 1 to about 100 dry gsm, preferably about 15 to about 30 dry gsm, on any coater including but not limited to blade, rod, gate-roll, slot die, extrusion, cascade, and gravure.

Figure 2:
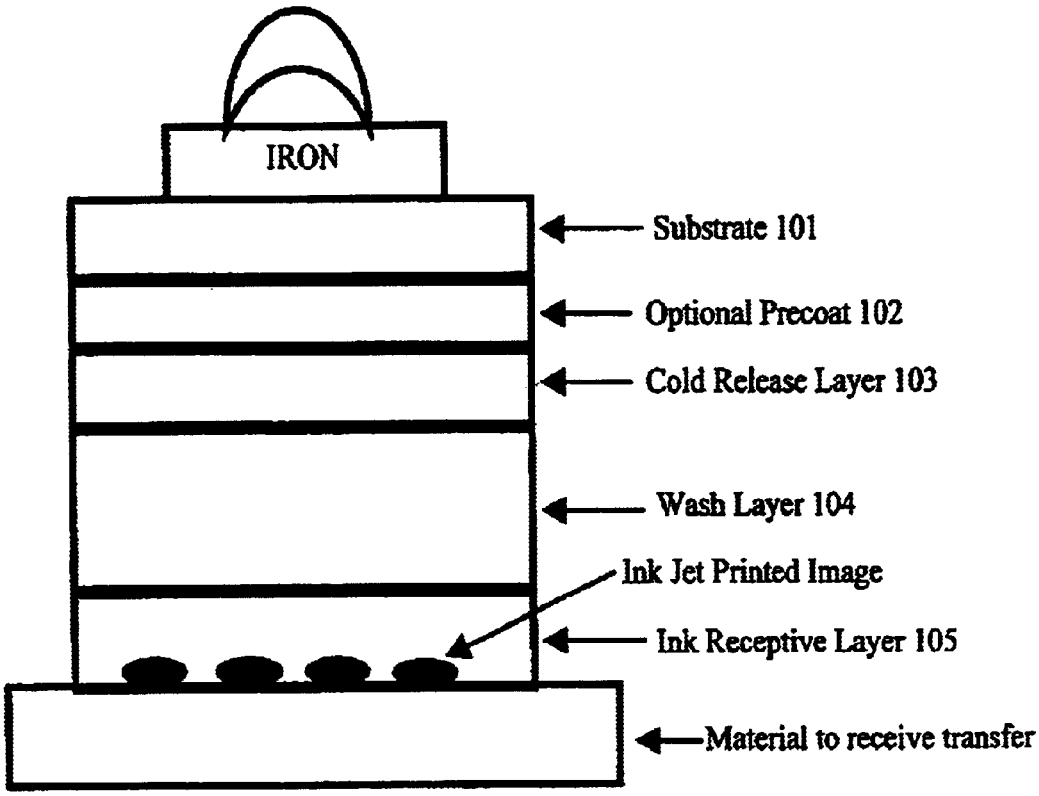
FIG. 2 is a cross-sectional view of the substrate with coatings in the process of being heated on the material to which the ink jet printed image will be transferred.

FIG. 2 depicts the invention being heated for transfer of an ink jet printed image to a receiving material. An iron or other heat source is applied to the uncoated side of the substrate 101, while on the opposite side of the substrate, ink receptive layer 105 is in contact with the receiving material (for example, but not limited to ceramic mugs, t-shirts, banners, and flags).

Figure 3:
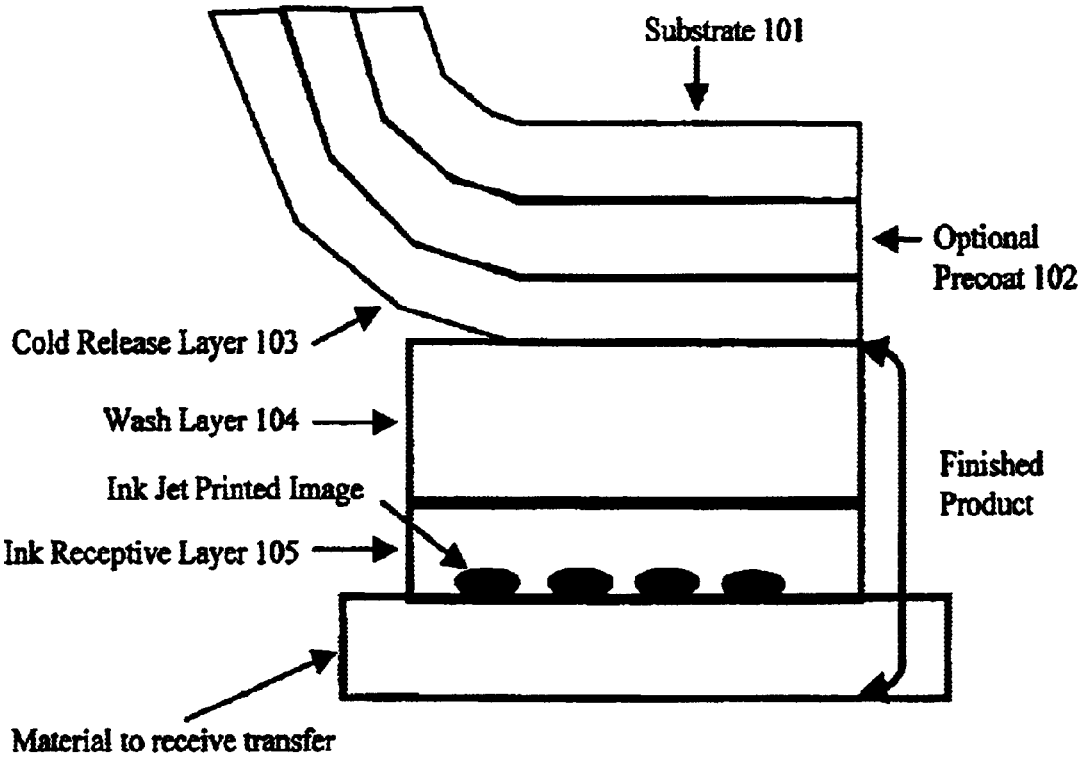
FIG. 3 is a cross-sectional view of the invention wherein the wash layer and ink receptive layer are deposited after cooling onto the transfer material and the substrate, optional precoat layer and cold release layer are removed.

FIG. 3 depicts the invention after the heat was applied as in FIG. 2. Upon cooling, the substrate 101, the optional precoat 102 and cold release layer 103 are removed. The receiving material retains the ink jet printed image covered by the ink receptive layer 105 which is in turn covered by the wash layer 104. The ink receptive layer 105 and wash layer 104 are fused by the heating process as to encapsulate the dyes and attach them to the receiving material.

EXAMPLE 1

A substrate was prepared by forming on a fourdrinere paper machine, a fiber mat consisting of 20% hardwood fibers, 60% softwood fibers, and 20% precipitated calcium carbonate. The substrate was then surface treated with oxidized starch to improve surface smoothness and subsequent coating adhesion. The sheet included common retention and formation aids; and an ASA hydrophobic surface modifier known to one skilled in the art.

EXAMPLE 2

A precoat coat layer was prepared by coating 15 dry gsm of the following coating on a blade coater using the base sheet from example 1. The coating is made up of clay pigment along with high levels of latex and polyvinyl alcohol binder to form a dense surface which resists penetration by and absorption of subsequent coating layers (i.e. increases "holdout"). The improved holdout reduces the necessary coat weight of the cold release coating to achieve a desired level of release. Low cold release coat weights allow for economical production of this product.

| | Dry parts | |
|---|---|---|
| #2 Coating Clay | 100 | NuClay from Engelhard |
| Polyvinyl alcohol | 4 | Arivol 107 from Air Products |
| Thickener | 0.4 | Carboxymethylcellulose from Hercules |
| Latex Binder | 4 | Dow 620 from Dow Chemical |

The coated sheet was run through a hot nip super calendar to smooth and densify the surface. This sheet has excellent holdout for the cold release layer coating.

EXAMPLE 3a

A cold release layer was prepared by coating 2 dry gsm of the following coating on a gravure coater using the basesheet from example 2. The use of silicone chemistry to produce a cold peel heat transfer sheet is unique and a key element of this invention. The right combination of adhesion to subsequent coating layers must be balanced with the desired release properties after the image is transferred. A silicone surface with a surface energy that is too low will not allow adhesion with subsequent coating layers. Consequently, the wash layer will either not adhere to or will prematurely release from the cold release layer. A silicone surface with a surface energy that is too high will not release the subsequent layers after the transfer is made, which results in an unusable product. A blend of silicones to achieve the desired release characteristics is also permissible in this invention. The use of a matting agent is optional, though generally desirable in this invention to give a finished matte appearance. If the matting agent is not used, the finished product will have a gloss appearance. If the material which receives the transfer is matte in appearance, users generally want the transfer also to be matte. This invention includes both incorporating and not incorporating a matting agent in the cold release layer. In this example silicone chemistry is thermally cured.

| | Dry parts | |
|---|---|---|
| Emulsion Silicone | 100 | Silcolease PC 197 from Rhodia |
| Matting Agent | 12 | TS 100 from WC Manufacturing |
| Catalyst | 5 | Silcolease PC 60 from Rhodia |

EXAMPLE 3b

An alternative cold release layer was prepared by coating 2 dry gsm of the following coating on a gravure coater using the basesheet from example 2. This coating contains a controlled release additive (CRA) to modify the surface energy and release characteristics. The use of a CRA is crucial to achieve the desired release characteristics, depending upon the silicone chemistry chosen. This example was thermally cured.

| | Dry parts | |
|---|---|---|
| Emulsion Silicone | 100 | Silcolease PC 197 from Rhodia |

-continued

| | Dry parts | |
|---|---|---|
| CRA | 0.35 | Silcolease PC 800 from Rhodia |
| Matting Agent | 12 | TS 100 from WC Manufacturing |
| Catalyst | 5 | Silcolease PC 60 from Rhodia |

EXAMPLE 4

The coating in example #3a was coated upon a corona treated polyextruded basesheet from Jen-Coat. The release characteristics were good.

EXAMPLE 5

The coating in Example #3a was coated upon SCK from Rhinelander. The release characteristics were good.

EXAMPLE 6

A glossy cold release layer was prepared by coating 3 dry gsm of a UV curable silicone coating on a gravure coater using the basesheet from Example 2. The UV curable silicone was RadKote 864PR from RadCure. It was cured using ultra-violet light from a single Fusion H-bulb at a watt density of 300 watts/cm$^2$ at a speed of 50 fpm. The release characteristics were good.

EXAMPLE 7

A wash layer was prepared by coating 35 dry gsm of the following coating on a gravure coater using the sheet from Example 3a. Optionally the cold release layer can be flame or corona treated prior to coating the wash layer. Such treatments improve adhesion without affecting release. The use of ethylene acrylic acid ("EAA") to product wash layers is well known in the literature for over 30 years and to those skilled in the art. What is unique to this invention is the addition of a urethane adhesion promoter in combination with fluorosurfactant wetting (or commonly referred to as leveling) agents, and non-water soluble plasticizers. The urethane adhesion promoter improves the adhesion of the wash layer onto the material which receives the transfer. This helps prevent cracking and brittleness in the finished product, even after multiple wash cycles. The fluorosurfactant wetting agents are a key part of this invention in that without them, it can be difficult or impossible to get good adhesion to and wetting of the cold release layer during manufacture. However, they do not give permanent adhesion so that the cold release layer can be peeled off after the transfer is made.

Also important to this invention is the non-water soluble plasticizers. These plasticizers keep the transfer soft and pliable, giving a desirable feel or "hand" to the transfer, especially onto cloth. Furthermore, these plasticizers lower the melt viscosity for better penetration of the coating into the fabric during the heat transfer process. This improves the adhesion of the transferred image to the fabric and reduces the likelihood of the coating flaking off. Though water soluble plasticizers, including polyethylene glycol, will give a good hand immediately after transfer, they wash out in a few wash cycles, leaving a transfer that is more rigid, and likely to crack over time. In this construction, the transfer will remain soft and pliable over time and not crack, even after many wash cycles.

| | Dry Parts | |
|---|---|---|
| EAA | 95 | Michem Prime 4983R from Michelman |
| Urethane adhesion promoter | 5 | Neores R9320 from Zeneca Resins |
| Non-water soluble plasticizer | 10 | Atesynth 2158 from Boehme Filatex |
| Fluorosurfactant | 0.25 | Zonyl FSO from DuPont |

EXAMPLE 8

Alternatively, a wash layer was prepared by coating 35 dry gsm of the following coating on a gravure coater using the basesheet sheet from Example 3a. In this example, a low $T_g$ (i.e. melting point less than 10° C., preferably less than 0° C.) ethylene-vinyl chloride emulsion was incorporated in the wash layer. The ethylene-vinyl chloride emulsion also helps improve adhesion of the wash layer onto the material that receives the transfer. Ethylene-vinyl chloride emulsion also gives a softer surface with a more desirable hand. This prevents cracking and brittleness in the finished product, even after multiple wash cycles. The addition of the ethylene-vinyl chloride emulsion allows for the optional exclusion of the non-water soluble plasticizer. However, it is most desirable to include the non-water soluble plasticizer.

| | Dry Parts | |
|---|---|---|
| EAA | 70 | Michem Prime 4990 from Michelman |
| ethylene-vinyl chloride emulsion | 25 | Airflex 124 from Air Products |
| Urethane adhesion promoter | 5 | Neores R9320 from Zeneca Resins |
| Fluorosurfactant | 0.25 | Zonyl FSO from DuPont |

EXAMPLE 9

Similar to Example 8, a wash layer was prepared by coating 35 dry gsm of the following coating on a gravure coater using the basesheet sheet from Example 3a. In this example, the dispersant was incorporated in the construction.

| | Dry Parts | |
|---|---|---|
| EAA | 70 | Michem Prime 4990 from Michelman |
| Ethylene-Vinyl Chloride emulsion | 25 | Airflex 124 from Air Products |
| Urethane adhesion promoter | 5 | Neores R9320 from Zeneca Resins |
| Non-water soluble plasticizer | 10 | Atesynth 2158 from Boehme Filatex |
| Fluorosurfactant | 0.25 | Zonyl FSO from DuPont |

EXAMPLE 10

Alternatively, a wash layer was prepared by coating 35 dry gsm of the following coating on a gravure coater using the basesheet sheet from Example 3a. Unique to this construction is the addition of a high molecular weight copolyamide hot melt resin. The resin is an alternative to EAA, which offers excellent adhesion to the material being transferred to, as well as good resistance to detergents. In this invention, the copolyamide resin may be incorporated by itself or along with EAA to form a suitable wash layer.

| | Dry Parts | |
|---|---|---|
| EAA | 20 | Michem Prime 4983-40R from Michelman |
| Copolyamine resin | 80 | Platamid M548 from Elf Atochem |
| Non-water soluble plasticizer | 10 | Atesynth 2158 from Boehme Filatex |
| Fluorosurfactant | 0.25 | Zonyl FSO from DuPont |

EXAMPLE 11

Alternatively, a wash layer was prepared by coating 35 dry gsm of the following coating on a gravure coater using the basesheet sheet from Example 3a. Unique to this construction is the addition of polyethylene wax along with the EAA. The addition of wax gives a coating which is more abrasion resistant due to its higher melt point than EAA alone. This example is well suited for transfer onto rigid materials, including ceramic mugs. This example also represents a unique aspect of this invention: the addition of a non-water soluble antioxidant. The antioxidant prevents yellowing either with the application of excessive heat or over time (which are the shortcomings of most commercially available sheets). Most heat transfer components, including wax, EAA, and copolyamide will yellow when subjected to excessive high temperature. Heat transfer products are susceptible to misuse, especially with home users. Thus it is critical that the product not yellow even when excessive heat is applied to make the transfer. It is important that the antioxidant not be water soluble so that it is not washed out by the end user. Antioxidants that are water soluble may help prevent yellowing during the transfer, but are removed in the first few wash cycles, allowing for yellowing over time. The addition of isopropanol and/or acetone is necessary to temporarily solubilize the non-water soluble antioxidant and disperse it into the coating. The isopropanol and acetone flash off during drying, leaving the antioxidant in a non-water soluble state in the coating.

| | Dry Parts | |
|---|---|---|
| EAA | 95 | Michem Prime 4990 from Michelman |
| Polyethylene wax | 20 | Michem Emulsion 98040 M1 from Michelman |
| Urethane adhesion promoter | 5 | Neores R9320 from Zeneca Resins |
| Non-water soluble plasticizer | 10 | Atesynth 2158 from Boehme Filatex |
| Non-Water soluble Antioxidant | 0.4 | Irganox 1010 from Ciba |
| Isopropanol | 27.5 | Solvent for antioxidant |
| Acetone | 1.6 | Solvent for antioxidant |
| Fluorosurfactant | 0.25 | Zonyl FSO from DuPont |

EXAMPLE 12

Alternatively, a wash layer was prepared by coating 35 dry gsm of the following coating on a gravure coater using the basesheet sheet from Example 3a. A key component of this invention is the addition of cationic polymers, both water soluble and non-water soluble. The cationic polymers chemically interact with the ink jet inks by forming salt precipitates of the dyes. These precipitates retain the original color of the dye, but prevent the dye from being water soluble. Consequently, the dyes are locked into the structure and do not wash out of the transfer. This prevents the image from fading over time even after multiple wash cycles.

| | Dry parts | |
|---|---|---|
| Polyethylene wax | 95 | Acumist D9 from Allied Signal |
| Water soluble Cationic Polymer | 0.3 | Luviquat MS370 from BASF |
| Non-water soluble plasticizer | 10 | Atesynth 2158 from Boehme Filatex |
| Non-Water soluble Antioxidant | 0.4 | Irganox 1010 from Ciba |
| Isopropanol | 27.5 | Solvent for antioxidant |
| Acetone | 1.6 | Solvent for antioxidant |
| Fluorosurfactant | 0.3 | Zonyl FSO from DuPont |

EXAMPLE 13

An ink receptive layer was prepared by coating 22 dry gsm of the following coating on a gravure coater using the basesheet sheet from Example 8. The generation of an ink receptive, yet non-water soluble, layer is quite difficult. Most ink receptive layers used in ink jet media incorporate water soluble polymers to capture the inks during ink jet printing. This works fine for materials which are not subjected to water. However, in the construction of a washable heat transfer media, the ink receptive layer would be washed away. This invention contains a structure made up of non-water soluble, yet ink receptive materials. Before heat transfer, this coating remains quite porous, absorbing the inks. After transfer, however, the coating melts and coalesces, trapping the inks within itself. Additionally, a key unique part of this invention is the addition of water soluble and non-water soluble cationic polymers. The cationic polymers chemically interact with the ink jet inks by forming salt precipitates of the dyes. These precipitates retain the original color of the dye, but prevent the dye from being water soluble. Consequently, the dyes are locked into the structure and do not wash out of the transfer. Non-water soluble materials are critical so that they, along with any dye precipitated on the cationic surface, cannot wash out of the structure over time. This prevents the image from fading over time after multiple wash cycles.

In this example, a very porous polyamide powder with a low melt point is incorporated to absorb ink. The addition of the non-water soluble acrylic cationic pigment chemically binds the dyes to the structure both before and after the transfer. This acrylic also melts and coalesces into the structure during transfer. The water soluble cationic polymer improves the crispness of the printed image. Without this polymer, the ink will "wick", or form rough edges due to capillary action transporting the ink laterally across the printed surface. The cationic polymer chemically traps the dyes so that they cannot move through the sheet. Though this polymer eventually washes out after the image is transferred, it is no longer needed as the dyes are retained by encapsulation in the fused coating and by attachment to the water-insoluble cationic polymers.

In addition, the ethylene-vinyl chloride emulsion is incorporated as a binder to hold the porous structure together before transferring the image. Ethylene-vinyl chloride is a soft polymer which contributes to the soft hand of the transfer, is nonionic and thus compatible with the cationic polymers in the coating, and is a good binder capable of binding the coating at lower usage levels thus leaving the coating very porous and open, making it ideal for this application. A low $T_g$ ethylene-vinyl chloride emulsion is most desirable to coalesce with the rest of the ink receptive coating materials during heat transfer. Additionally, a key component of this invention for the ink receptive layer is an antioxidant. An antioxidant has been incorporated to prevent yellowing as explained in Example 11.

| | Dry parts | |
|---|---|---|
| Polyethylene wax | 3 | MPP 635F from Micropowders |
| High porosity Polyamide powder | 80 | Orgasol 3501 from Elf Atochem |
| Ethylene-Vinyl Chloride emulsion | 6 | Airflex 144 from Air Products |
| Cationic acrylic synthetic pigment | 7 | Basoplast 265D from BASF |
| Cationic Polymer | 0.35 | Luviquat MS370 from BASF |
| Non-water soluble plasticizer | 17.5 | Atesynth 2158 from Boehme Filatex |
| Dispersion stabilizer | 0.6 | M19542 from Elf Atochem |
| Non-water soluble Antioxidant | 0.35 | Irganox 1010 from Ciba |
| Isopropanol | 24.8 | Solvent for antioxidant |
| Acetone | 1.4 | Solvent for antioxidant |
| Wetting/Flow agent | 0.08 | Triton X-100 from Union Carbide |

EXAMPLE 14

Alternatively, an ink receptive layer was prepared by coating 22 dry gsm of the following coating on a gravure coater using the basesheet sheet from Example 8. Though similar to Example 13, a key element has been added to help absorb ink, specifically an inorganic high porosity silica pigment. In this construction, the silica is non-water soluble, yet absorbs in jet ink, giving a porous structure before transfer. After the transfer, the silica is trapped within the coalesced structure. A significant fraction of non-water soluble inorganic pigments can be included in this invention while still yielding a product with good performance.

| | Dry parts | |
|---|---|---|
| High porosity silica | 20 | Gasil HP-39 from Crossfield |
| High porosity Polyamide powder | 60 | Orgasol 3501 from Elf Atochem |
| Ethylene vinyl chloride emulsion | 6 | Airflex 144 from Air Products |
| Cationic acrylic synthetic pigment | 7 | Basoplast 265D from BASF |
| Cationic Polymer | 0.35 | Luviquat MS370 from BASF |
| Non-Water soluble Antioxidant | 0.6 | Irganox 1010 from Ciba |
| Isopropanol | 24.8 | Solvent for antioxidant |
| Acetone | 1.4 | Solvent for antioxidant |
| Wetting/Flow agent | 0.18 | Triton X-100 from Union Carbide |
| Wetting/Flow agent | 0.12 | Zonyl FSO from DuPont |

EXAMPLE 15

Alternatively, an ink receptive layer was prepared by coating 22 dry gsm of the following coating on a gravure coater using the basesheet sheet from Example 8. This example is a variation on Example 13.

| | Dry parts | |
|---|---|---|
| Polyethylene Wax | 15 | MPP 635VF from Micropowders |
| High porosity Polyamide powder | 68 | Orgasol 3501 from Elf Atochem |
| ethylene vinyl chloride emulsion | 6 | Airflex 144 from Air Products |
| Cationic acrylic synthetic pigment | 7 | Basoplast 265D from BASF |
| Cationic Polymer | 0.35 | Luviquat MS370 from BASF |
| Non-water soluble plasticizer | 17.5 | Atesynth 2158 from Boehme Filatex |
| Dispersion stabilizer | 0.6 | M1954-2 from Elf Atochem |
| Non-water soluble Antioxidant | 0.6 | Irganox 1010 from Ciba |
| Isopropanol | 24.8 | Solvent for antioxidant |
| Acetone | 1.4 | Solvent for antioxidant |
| Wetting/Flow agent | 0.18 | Triton X-100 from Union Carbide |
| Wetting/Flow agent | 0.12 | Zonyl FSO from DuPont |

It is understood that while the invention has been described in conjunction with the detailed description thereof, that the foregoing description is intended to illustrate and not limit the scope of the invention, which is defined by the scope of the appended claims. Other aspects, advantages, and modifications are within the claims.

What is claimed is:

1. An ink jet printable heat transfer material comprising:

a cold release layer comprising:

one or more silicones;

one or more crosslinkers; and one or more controlled release additives for silicone chemistries;

a wash layer;

and an ink receptive layer.

2. The ink jet printable heat transfer material of claim 1 wherein the cold release layer further comprises one or more matting agents.

3. The ink jet printable heat transfer material of claim 1 wherein the silicones comprise one or more of the group consisting of thermally curable solvent based silicone, thermally curable solventless silicone, thermally curable emulsion silicone, ultraviolet curable acrylate silicone, and ultraviolet curable epoxy silicone.

4. The ink jet printable heat transfer material of claim 1 wherein the silicones comprise about 1 to about 99 dry percent of the cold release layer.

5. The ink jet printable heat transfer material of claim 1 wherein the crosslinkers comprise one or more of the group consisting of tin catalyzed crosslinkers, platinum catalyzed crosslinkers, ultraviolet free radical catalyzed crosslinkers, and ultraviolet cationic catalyzed crosslinkers.

6. The ink jet printable heat transfer material of claim 2 wherein the matting agents comprise one or more of the group consisting of fumed silica, precipitated silica, solgel silica, colloidal silica, silicates, nylon copolymers, ground calcium carbonate, precipitated calcium carbonate, alumina, and clay.

7. The ink jet printable heat transfer material of claim 1 wherein the cold release layer further comprises one or more defoamers.

8. The ink jet printable heat transfer material of claim 1 wherein the cold release layer further comprises one or more dyes.

9. The ink jet printable heat transfer material of claim 1 wherein the cold release layer further comprises one or more optical brighteners.

10. The cold release layer of claim 1 wherein the cold release layer is coated at a coat weight of about 0.5 to about 7 dry gsm.

11. The cold release layer of claim 1 wherein the cold release layer is coated at a coat weight of about 1 to about 5 dry gsm.

12. The ink jet printable heat transfer material of claim 1 wherein the wash layer comprises:

one or more ethylene acrylic acids;

one or more non-water soluble plasticizers;

one or more ethylene-vinyl chlorides;

one or more urethane adhesion promoters;

one or more fluorosurfactant wetting and flow agents;

one or more copolyamine resins;

one or more hard waxes;

one or more non-water soluble antioxidants; and a mixture of water soluble and non-water soluble cationic polymers.

13. The ink jet printable heat transfer material of claim 12 wherein the hard waxes comprise one or more of the group consisting of polyethylene wax and polypropylene wax.

14. The ink jet printable beat transfer material of claim 12 wherein the ethylene acrylic acid is between about 10 and about 100 dry percent of the wash layer.

15. The ink jet printable heat transfer material of claim 12 wherein the non-water soluble plasticizer is between about 0 and about 30 dry percent of the wash layer.

16. The ink jet printable heat transfer material of claim 12 wherein the ethylene-vinyl chloride is between about 0 and about 50 dry percent of the wash layer.

17. The ink jet printable heat transfer material of claim 12 wherein the urethane adhesion promoter is between about 0 and about 50 dry percent of the wash layer.

18. The ink jet printable heat transfer material of claim 12 wherein the fluorosurfactant wetting and flow agent is between about 0 and about 5 dry percent of the wash layer.

19. The ink jet printable heat transfer material of claim 12 wherein the copolyamine resin is between about 0 and about 100 dry percent of the wash layer.

20. The ink jet printable heat transfer material of claim 12 wherein the hard wax is between about 0 and about 100 dry percent of the wash layer.

21. The ink jet printable heat transfer material of claim 12 wherein the antioxidant is between about 0 and about 10 dry percent of the wash layer.

22. The ink jet printable heat transfer material of claim 12 wherein the cationic polymer is between about 0 and about 20 dry percent of the wash layer.

23. The ink jet printable heat transfer material of claim 12 wherein the wash layer further comprises one or more antifoaming agents.

24. The ink jet printable heat transfer material of claim 12 wherein the wash layer is coated at a coat weight of about 1 to about 100 dry gsm.

25. The ink jet printable heat transfer material of claim 12 wherein the wash layer is coated at a coat weight of about 30 to about 40 dry gsm.

26. The ink jet printable heat transfer material of claim 1 wherein the ink receptive layer comprises:

one or more hard waxes;

one or more high porosity powders;

one or more ethylene-vinyl chloride emulsions;

one or more water soluble cationic polymers;

one or more non-water soluble cationic polymers;

one or more non-water soluble plasticizers;

one or more non-water soluble antioxidants;

a mixture of flow and wetting agents; and one or more high porosity inorganic material.

27. The ink jet printable heat transfer material of claim 26 wherein the high porosity powders comprise one or more of the group consisting of polyamide resin and copolyamide resin.

28. The ink jet printable heat transfer material of claim 26 wherein the hard wax comprises one or more of the group consisting of polyethylene wax and polypropylene wax.

29. The ink jet printable heat transfer material of claim 26 wherein the hard wax is between about 0 and about 50 dry percent of the ink receptive layer.

30. The ink jet printable heat transfer material of claim 26 wherein the high porosity powder is between about 50 and about 95 dry percent of the ink receptive layer.

31. The ink jet printable heat transfer material of claim 26 wherein the ethylene-vinyl chloride emulsion is between about 0 and about 20 dry percent of the ink receptive layer.

32. The ink jet printable heat transfer material of claim 26 wherein the water soluble cationic polymer is between about 0 and about 15 dry percent of the ink receptive layer.

33. The ink jet printable heat transfer material of claim 26 wherein the non-water soluble cationic polymer is between about 0 and about 20 dry percent of the ink receptive layer.

34. The ink jet printable heat transfer material of claim 26 wherein the non-water soluble plasticizer is between about 0 and about 40 dry percent of the ink receptive layer.

35. The ink jet printable heat transfer material of claim 26 wherein the non-water soluble antioxidant is between about 0 and about 10 dry percent of the ink receptive layer.

36. The composition of claim 26 wherein the mixture of flow and wetting agents is between about 0 and about 5 dry percent of the ink receptive layer.

37. The ink jet printable heat transfer material of claim 26 wherein the high porosity powder is between about 50 and about 95 dry percent of the ink receptive layer.

38. The ink jet printable heat transfer material of claim wherein the high porosity inorganic material is between about 0 and about 80 dry percent of the ink receptive layer.

39. The ink jet printable heat transfer material of claim 26 wherein the high porosity inorganic material comprises one or more of the group consisting of alumina, silica gel, precipitated silica, fumed silica, colloidal silica and solgel silica.

40. The ink jet printable heat transfer material of claim 26 wherein the ink receptive layer further comprises one or more anti-foaming agents.

41. The ink jet printable heat transfer material of claim 26 wherein the ink receptive layer is coated at a coat weight of about 1 to about 100 dry gsm.

42. The ink jet printable heat transfer material of claim 26 wherein the ink receptive layer is coated at a coat weight of about 15 to about 30 dry gsm.

43. An ink jet printable heat transfer material comprising:

a substrate, said substrate comprising hardwood fibers, softwood fibers and precipitated calcium carbonate;

a precoat layer, said precoat layer comprising clay, polyvinyl alcohol, carboxymethylcellulose and a binder;

a cold release layer, said cold release layer comprising emulsion silicone, a matting agent and catalyst;

a wash layer, said wash layer comprising ethylene acrylic acid, urethane adhesion promoter, non-water soluble plasticizer, and fluorosurfactant; and an ink receptive layer, said ink receptive layer comprising polyethylene wax, high porosity polyamide powder, ethylene-vinyl chloride emulsion, cationic acrylic synthetic pigment, cationic polymer, non-water soluble plasticizer, dispersion stabilizer, non-water soluble antioxidant, isopropanol, acetone and a mixture of wetting and flow agents.

* * * * *